US007518047B2

(12) United States Patent
Koszela

(10) Patent No.: US 7,518,047 B2
(45) Date of Patent: Apr. 14, 2009

(54) STRING CLEANING DEVICE AND METHOD

(76) Inventor: Robert Koszela, 1544 S. Beverly Glen Blvd., Los Angeles, CA (US) 90024

( * ) Notice: Subject to any disclaimer, the term of this patent is extended or adjusted under 35 U.S.C. 154(b) by 226 days.

(21) Appl. No.: 11/535,963

(22) Filed: Sep. 27, 2006

(65) Prior Publication Data

US 2008/0072734 A1 Mar. 27, 2008

(51) Int. Cl.
*G10D 1/12* (2006.01)

(52) U.S. Cl. ..... 84/287 R; 15/220.4

(58) Field of Classification Search ..... 84/297 R; D32/35, 40; D4/120; 15/220.4, 88
See application file for complete search history.

(56) References Cited

FOREIGN PATENT DOCUMENTS

GB 2222298 A * 2/1990

* cited by examiner

*Primary Examiner*—Jeffrey Donels
*Assistant Examiner*—Jianchun Qin
(74) *Attorney, Agent, or Firm*—James A. Italia; Italia IP

(57) ABSTRACT

A device to clean one or more strings, the string cleaning device comprising a body having a handle at one end of said body and a cleaning region for cleaning on the opposite end, wherein said cleaning region includes a pair of semi-rigid pad adapting portions and a cleaning pad fixably attached thereto wherein the pad adapting portions form a substantially U-shape so as to allow said stings to be moved through the opening formed by said U-shaped formation so as to slidably retain said strings between said cleaning pads attached to said pad adapting portions when the strings are being cleaned.

6 Claims, 4 Drawing Sheets

10
11
12
13
14
15
17
18
22
23
26
30
31
32

Detail A

STRING CLEANING DEVICE AND METHOD

BACKGROUND OF INVENTION

This application relates generally to a string cleaning device and a method for cleaning strings. More specifically, this application relates to a string cleaning device usable for cleaning strings that are taught and/or secured at each end. More specifically, this application relates to a string cleaning device usable for cleaning stringed instruments.

This application relates to a string cleaner that gives a user means to maintain the condition of instrument strings located on any stringed instrument (acoustic guitar, electric guitar, mandolin, violin, viola, cello, banjo, dulcimer, etc.) without the use of solvents or cleaners, however, solvents or cleaners maybe used if desired by the user.

Instrument strings begin to tarnish and rust the moment they are removed from the packaging in which they are sold and come into contact with moisture in the air. This process is greatly accelerated by the moisture and acidity introduced when a user's fingers come in contact with the strings while playing the instrument. The amount of acidity and moisture varies from user to user and, so it stands to reason that, the rate of tarnish and rust will vary in direct proportion.

Tarnished, rusted, corroded, and otherwise dirty strings damage instruments and hinder the quality of tone produced by otherwise clean vibrating strings. Although tarnish, rust, corrosion, and/or dirt will eventually build-up on the entire surface of the strings, it begins, and is often worst, where it remains unseen between the fret board of the instrument and strings. In fact, the true condition of a string is unable to be discerned as the user's fingers actually polish the visible side of the strings. The build-up on the side of the string that directly faces the instrument, in the case of a guitar, the fret board, is coarse and abrasive. When magnified, the tarnish, rust, corrosion, and/or dirt looks like stalactites hanging in a cave. The presence of this t tarnish, rust, corrosion, and/or dirt has an effect similar to a serrated knife-edge.

In the case of a guitar or similar designed instrument, as a user frets notes on strings, they (the strings) come into contact with frets and the wood or graphite fret board. Tarnished, rusted, corroded, and/or dirty strings wear away at frets and fret boards at a much more aggressive rate than smooth clean strings do. The damage to frets and fret boards, although repairable, can be costly. For example, the actual cost to replace frets and/or a damaged fret board can often cost as much as the guitar itself; on boutique, vintage, and/or collectible instruments, the value of the instrument can be severely diminished by the repair work as it is no longer in original factory condition. Further, the tone of the instrument will change.

The tone of different brands of metal strings on an instrument varies from brand to brand, and, often drastically. The one thing these various brands of strings have in common is that they will all eventually tarnish, rust, and/or corrode with use and when this happens, the strings' characteristic vibration will change. The most noticeable change is the loss of brightness (high end or "sparkle") and diminished sustain (the amount of time that a string will "ring" or vibrate after it is played). As build-up occurs overtime, strings progressively sound more and more dull creating an inconsistency in the tone of the instrument. Clean strings sound consistent with clean strings of the same brand installed on the same instrument and clean string resist breakage. Whereas with tarnished, rusted, corroded and/or otherwise dirty strings, the build-up makes it difficult to measure and recreate consistently since the tone varies with the degree of build-up.

Therefore, there is a need for a string cleaning device that would be able to effectively clean instrument strings. It would also be desirable if the strings would be able to be cleaned without the use of solvents or cleaners. It would also be desirable if the strings did not have to be removed from the instrument in order to be cleaned. Further, it would be desirable if the device to clean instrument strings was small, convenient, and affordable to both manufacture and for a user to purchase.

SUMMARY

This application discloses a string cleaning device that is economical to produce, of simple construction and capable of mass production, but also capable of providing a user a suitable means to clean and maintain strings on any stringed instrument.

In particular, this application discloses a device to clean one or more strings, the string cleaning device comprising: a body having a handle at one end of said body and a cleaning region for cleaning one or more strings on the opposite end; wherein said cleaning region comprises a pair of semi-rigid pad adapting portions forming a substantially U-shape.

This application also discloses a device to clean one or more strings, the string cleaning device comprising: a body having a handle at one end of said body and a cleaning region for cleaning on the opposite end; wherein said cleaning region comprises a pair of semi-rigid pad adapting portions and a cleaning pad fixably attached thereto wherein the pad adapting portions form a substantially U-shape so as to allow said stings to be moved through the opening formed by said U-shaped formation so as to slidably retain said strings between said cleaning pads attached to said pad adapting portions when the strings are being cleaned.

Further, this application discloses a method of cleaning one or more stings, the method comprising: inserting a one or more strings between two cleaning pads fixably attached to a pair of semi-rigid pad adapting portions wherein the pad adapting portions and said cleaning pads form a cleaning region that is a substantially U-shaped so as to allow said string or stings to be inserted through the opening formed by said U-shaped cleaning region; retaining said strings between said cleaning pads; applying a force to said cleaning region though a handle attached to the cleaning region, thereby moving the cleaning region lengthwise across the strings.

In a further embodiment, this application discloses a method for indicating when a desired torque setting has been obtained and exceeded by providing a torque-indicating mechanism coupled to a click arm and housed within a tube casing and coupled to a torque-limiting mechanism, setting a torque-adjusting mechanism coupled to said torque-limiting mechanism, and applying a force to the fastener engaged wrench whereby the method is further characterized by orientating the driver correctly thereby allowing activation of the torque-indicating mechanism.

Further, this application discloses a musical instrument cleaning system comprising: a musical instrument with one or more strings; and a device to clean one or more musical instrument strings, the string cleaning device comprising a body having a handle at one end of said body and a cleaning region for cleaning on the opposite end, wherein said cleaning region comprises a pair of semi-rigid pad adapting portions and a cleaning pad fixably attached thereto wherein the pad adapting portions form a substantially U-shape so as to allow said stings to be moved through the opening formed by said U-shaped formation so as to slidably retain said strings between said cleaning pads attached to said pad adapting portions when the strings are being cleaned.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figures 1, 2, 3, 4, 5, 6:
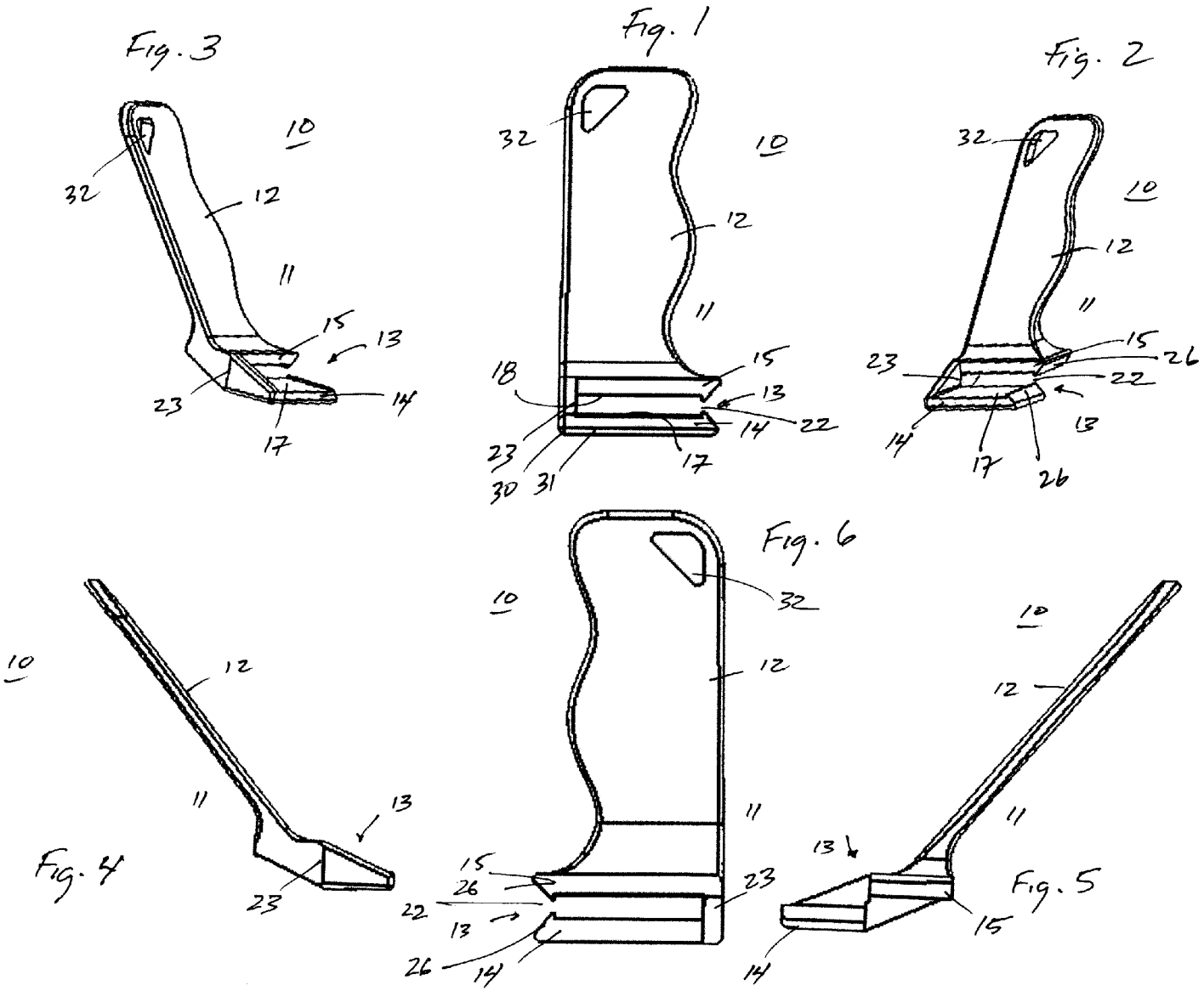
FIG. 1 is front plan view of a string cleaning device.
FIG. 2 is a perspective view of the device in FIG. 1.
FIG. 3 is a perspective view of the device in FIG. 1.
FIG. 4 is a side plan view of the device in FIG. 1.
FIG. 5 is a side plan view of the device in FIG. 1.
FIG. 6 is a rear plan view of the device in FIG. 1.

Referring to FIGS. 1-14, shown therein and generally designated by the reference character 10 is the preferred embodiment of the sting cleaning device 10 constructed in accordance with the following description. The device 10 comprises a body 11 that is preferably made out of a semi-rigid moldable material such as plastic, glass reinforced resin, ABS, and polystyrene. The body 11 includes a handle 12 and a cleaning region 13. In the preferred embodiment, the cleaning region 13 is formed out of a pair of semi-rigid pad adapting portions 14 and 15. As shown in FIGS. 1-14, pad adapting portions 14 and 15 form a substantially U-shape with an open 22 and closed portion 23. And as shown in FIGS. 10-14, the device 10 includes a cleaning pad 16 fixably attached to the inner surfaces 17 and 18 of the pad adapting portions 14 and 15. The cleaning pad 16 can be fixably attached to the inner surfaces 17 and 18 of the pad adapting portions 14 and 15 by any means known in the art, including but not limited to, an adhesive 29 applied to the back of the cleaning pad 16.

The cleaning pad 16 is characterized by an adhesive surface 29 and an abrasive surface 19 such that when it is used in the device 10 it sufficiently removes any build-up on the stings being cleaned. Any such abrasive cleaning pad would be sufficient, however, the 3M product, Scotch-Brite® Surface Conditioning Hand Pad (Product No. 7447) is particularly preferred.

In the preferred embodiment, the pad adapting portions 14 and 15 are sufficiently offset such that neither pad adapting portions 14 and 15 is directly above or below the other. See FIGS. 7, 8 and 14 which more clearly demonstrate this orientation. This particular offset orientation allows the user to generate a sufficient force through the handle 12 to the cleaning region 13 such that a minimal amount of pressure is required to clean a given string or set of strings 20.

Figure 18:
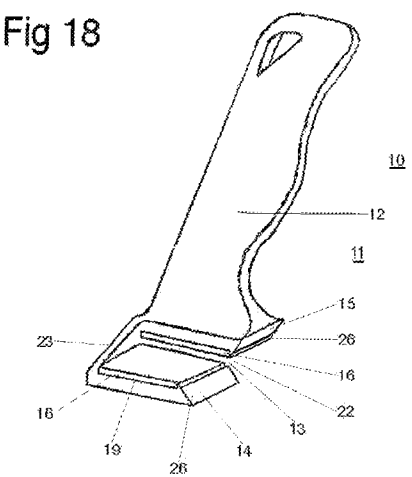
FIG. 18 is a perspective view of a fourth embodiment and preferred embodiment of the string cleaning device in FIG. 10; and, FIG. 19 is a perspective view of the string cleaning device during use according to some embodiments.
Figure 17:
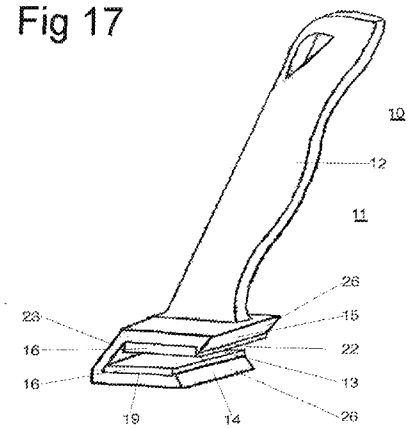
FIG. 17 is a perspective view of a third embodiment of a string cleaning device.
Figure 16:
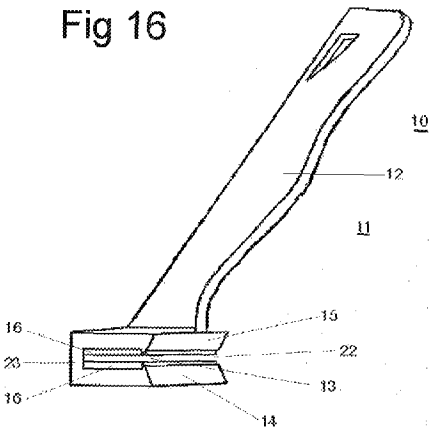
FIG. 16 is a perspective view of a second embodiment of a string cleaning device.

Referring to FIGS. 16-18, the cleaning region 13 can have varying degrees of offset between the pad adapting portions 14 and 15. For example in FIG. 16, the pad adapting portions 14 and 15 are approximately above and below each other. FIG. 17 shows yet another embodiment wherein the pad adapting portions 14 and 15 are partially above and below each other. FIG. 18 again shows the preferred embodiment wherein the pad adapting portions 14 and 15 are sufficiently offset such that neither pad adapting portions 14 and 15 is directly above or below the other.

Figure 19:
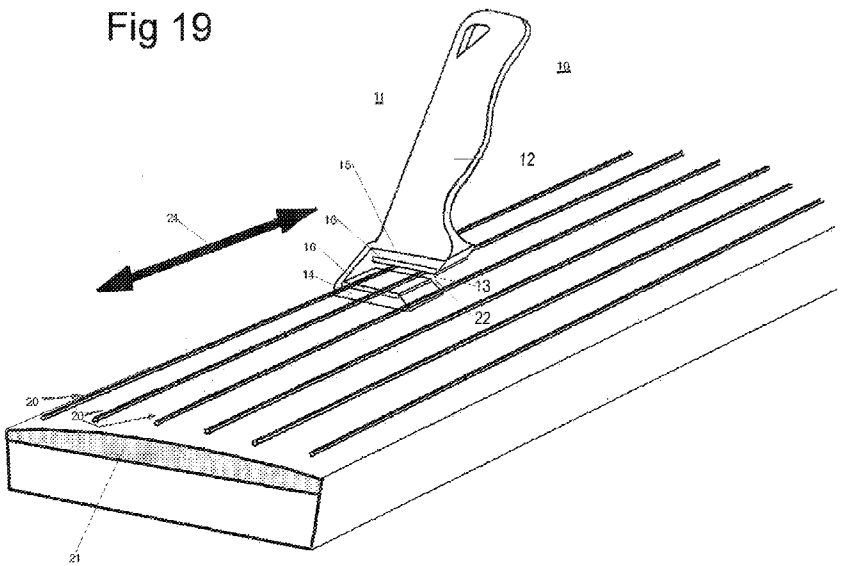

FIG. 19 shows the device 10 being used to clean one or more instrument stings 20 while still attached to the instrument. The portion of the instrument shown in FIG. 19 is of a fret board 21 located on a guitar; however, any similar portion of any stringed instrument could be used. Referring to FIG. 19, the user inserts a one or more strings through the opening 22 formed by said U-shaped cleaning region 13 such that the string or strings sit between the between the pad adapting portions 14 and 15, more specifically, the cleaning pads 16 attached to the inner surface 17 and 18 of the pad adapting portions 14 and 15. Once the string or strings 20 are retained between the cleaning pads 16, the user can apply a force to the cleaning region 13 through the handle 12 and move the cleaning region 13 in a lengthwise direction 24 across the strings to clean them.

The device 10 may also comprise means 25 for preventing a string or stings 20 from dislodging the cleaning pad or pads 16 from the pad adapting portions 14 and 15 when said device 10 is being used to clean a given string or strings 20. The means 25 include ramped portions 26 on the pad adapting portions 14 and 15 located at the opening 22 of the U-shaped cleaning region 13. The ramped portions 26 extend a length 27 up the side of the cleaning pad 16 such that when the user inserts a string 20 between the cleaning pads 16, the string 20 is not able to get between the pad 16 and the pad adapting portions 14 and 15 to dislodge the pad 16. See FIGS. 10 and 11.

Figures 7, 8, 9:
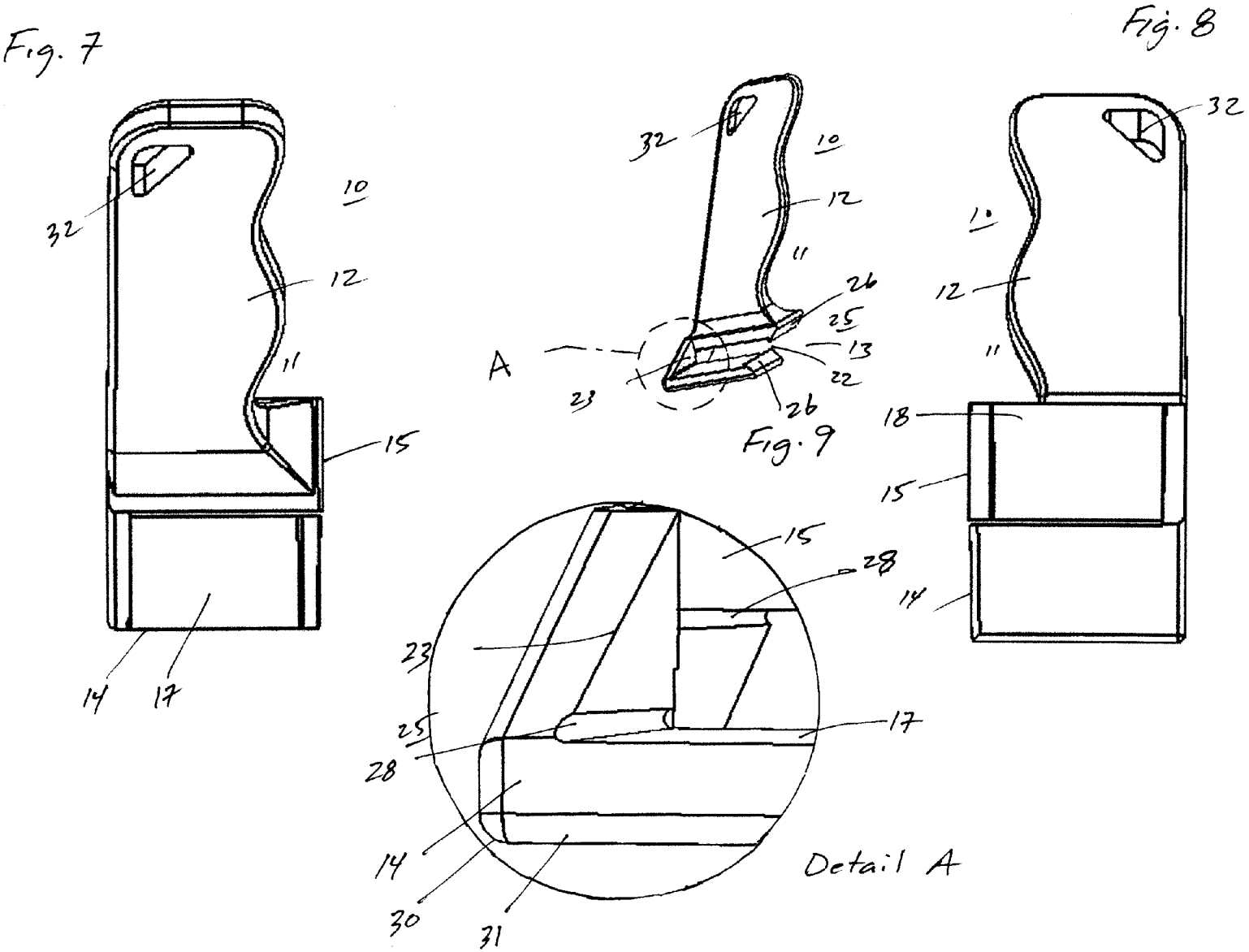
FIG. 7 is a top plan view of the device in FIG. 1.
FIG. 8 is a bottom plan view of the device in FIG. 1.
FIG. 9 is a perspective view similar to the view in FIG. 2, showing a detail of the represented portion of the device.
Figures 10, 11, 12, 13, 14:
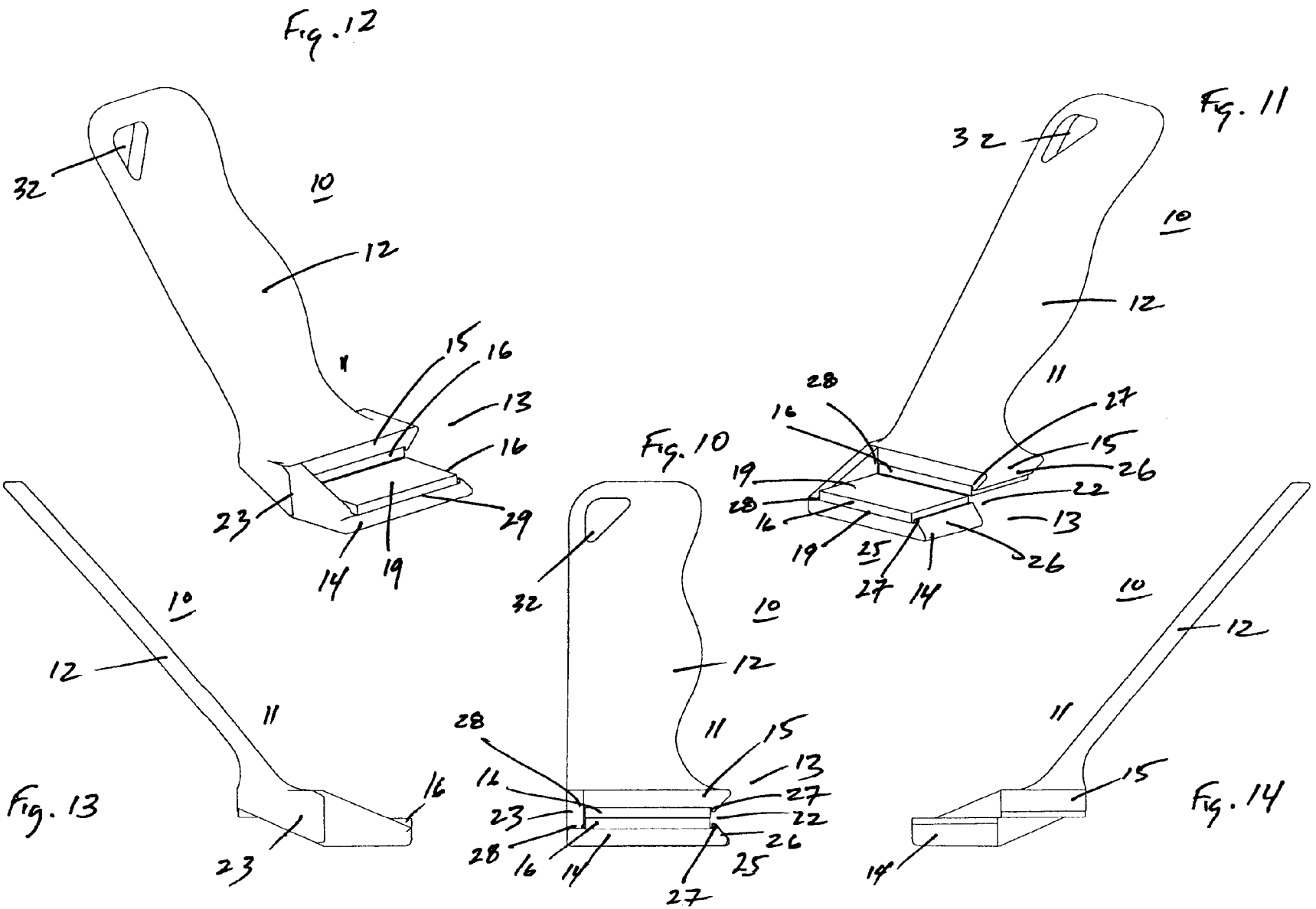
FIG. 10 is front plan view of the preferred embodiment with the cleaning pad attached to the of the a string cleaning device in FIG. 1.
FIG. 11 is a perspective view of the device in FIG. 10.
FIG. 12 is a perspective view of the device in FIG. 10.
FIG. 13 is a side plan view of the device in FIG. 10.
FIG. 14 is a side plan view of the device in FIG. 10.

An additional means 25 for preventing a string or stings 20 from dislodging the cleaning pad or pads 16 from the pad adapting portions 14 and 15 when said device 10 is being used clean a given string or strings 20 is shown in FIG. 9. The means 25 include grooves 28 on the pad adapting portions 14 and 15 located at the closed portion 23 of the U-shaped cleaning region 13. The grooves 28 allow the adhesive portion 29 of the cleaning pad 10 to sit within the grooves 28 such that when the user inserts a string 20 between the cleaning pads 16, the string 20 is not able to get between the pad 16 and the pad adapting portions 14 and 15 to dislodge the pad 16.

Figure 15:
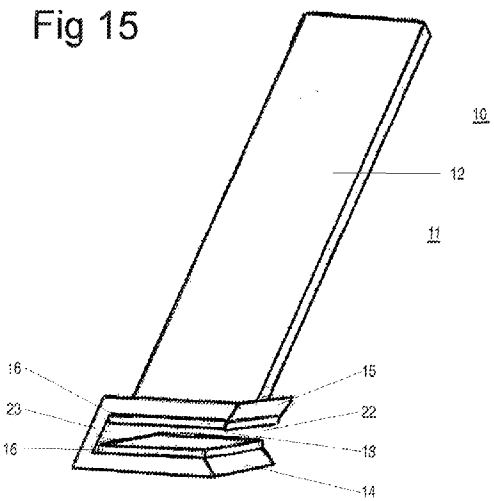
FIG. 15 is a perspective view of a first embodiment of a string cleaning device.

It should be appreciated that means 25 could be applied to the device 10 either together, separately or not at all. See FIG. 15 for an example of the device 10 without either means 25 for preventing a string or stings 20 from dislodging the cleaning pad or pads 16 from the pad adapting portions 14 and 15 when said device 10 is being used clean a given string or strings 20.

In yet a further embodiment of the device 10, the outer surface 30 of the lower pad adapting portion 14 includes rounded edges 31 such that when the device 10 is used to clean a string or stings 20, the rounded edge 31 allows the device 10 to glide across the instrument while avoiding any protrusions on the instrument's surface, for example the frets (not shown) located on a guitar's fret board 21. See FIG. 9.

In still a further embodiment of the device 10, the handle 12 may include an opening 32 to allow the user to attach the device 10 to a key chain (not shown). See FIG. 1.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A device to clean one or more strings, the string cleaning device comprising:

a body having a handle at one end of said body and a cleaning region for cleaning one or more strings on the opposite end;

wherein said cleaning region comprises a pair of semi-rigid pad adapting portions forming a substantially U-shape, wherein said pad adapting portions are approximately not above or below the other.

2. The string cleaning device of claim 1 wherein said pad adapting portions further comprise means for preventing a string from dislodging a cleaning pad when said pad is attached to said pad adapting portions.

3. A device to clean one or more strings, the string cleaning device comprising:

a body having a handle at one end of said body and a cleaning region for cleaning on the opposite end;

wherein said cleaning region comprises a pair of semi-rigid pad adapting portions and a cleaning pad fixably attached thereto wherein the pad adapting portions form a substantially U-shape so as to allow said stings to be moved through the opening formed by said U-shaped formation so as to slidably retain said strings between said cleaning pads attached to said pad adapting portions when the strings are being cleaned, wherein said pad adapting portions are approximately not above or below the other.

4. The string cleaning device of claim 3 wherein said pad adapting portions further comprise means for preventing a string from dislodging said cleaning pad from said pad adapting portions.

5. A method of cleaning one or more stings, the method comprising:

inserting a one or more strings between two cleaning pads fixably attached to a pair of semi-rigid pad adapting portions wherein the pad adapting portions and said cleaning pads form a cleaning region that is a substantially U-shaped so as to allow said string or stings to be inserted through the opening formed by said U-shaped cleaning region;

retaining said strings between said cleaning pads;

applying a force to said cleaning region though a handle attached to the cleaning region, thereby moving the cleaning region lengthwise across the strings, wherein said pad adapting portions are approximately not above or below the other.

6. The method of claim 5 wherein said pad adapting portions further comprise means for preventing a string from dislodging said cleaning pad from said pad adapting portions.

* * * * *